United States Patent [19]

Ragland, Jr.

[11] 4,455,505

[45] Jun. 19, 1984

[54] COLOR PICTURE TUBE HAVING IMPROVED TEMPERATURE COMPENSATING SUPPORT FOR A MASK-FRAME ASSEMBLY

[75] Inventor: Frank R. Ragland, Jr., Lancaster, Pa.

[73] Assignee: RCA Corporation, New York, N.Y.

[21] Appl. No.: 299,792

[22] Filed: Sep. 4, 1981

[51] Int. Cl.[3] ..... H01J 29/07

[52] U.S. Cl. ..... 313/404; 313/407

[58] Field of Search ..... 313/404, 405, 406, 407

[56] References Cited

U.S. PATENT DOCUMENTS

| | | | |
|---|---|---|---|
| 2,795,718 | 6/1957 | van Hekken et al. | 313/408 |
| 2,795,719 | 6/1957 | Morrell | 313/404 |
| 3,370,194 | 2/1968 | Schwartz et al. | 313/404 |
| 3,524,972 | 8/1970 | Cooper et al. | 313/405 |
| 3,700,948 | 10/1972 | Palac | 313/405 |
| 3,803,436 | 4/1974 | Morrell | 313/405 |
| 3,890,526 | 6/1975 | Palac | 313/408 |
| 3,935,497 | 1/1976 | Cowles et al. | 313/405 |
| 3,943,399 | 3/1976 | Sedivy | 313/404 |
| 3,986,072 | 10/1976 | Adamski | 313/404 |

*Primary Examiner*—Palmer C. Demeo
*Assistant Examiner*—Sandra L. O'Shea
*Attorney, Agent, or Firm*—Eugene M. Whitacre; Dennis H. Irlbeck

[57] ABSTRACT

An improved color picture tube of the type including an evacuated envelope enclosing a mask attached to a frame which is suspended in relation to a screen by novel support means. The support means includes an elongated metal arch member attached to the frame at two ends, with the central portion of the arch member being spaced from the frame. A spring has one end attached to the arch member between one of the ends and the central portion of the arch member. The other end of the spring engages the tube envelope.

7 Claims, 6 Drawing Figures

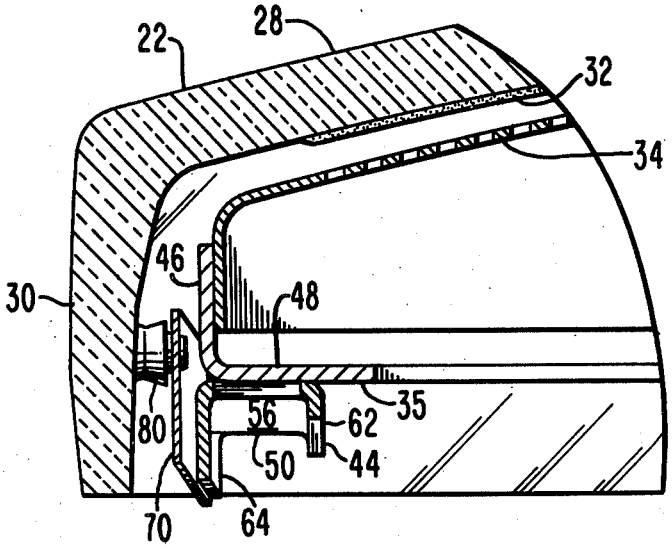
Fig. 3
Fig. 4
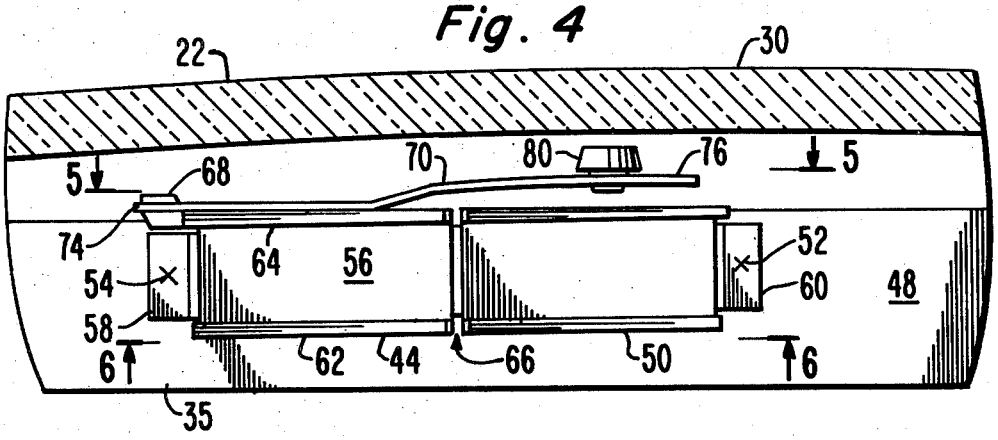
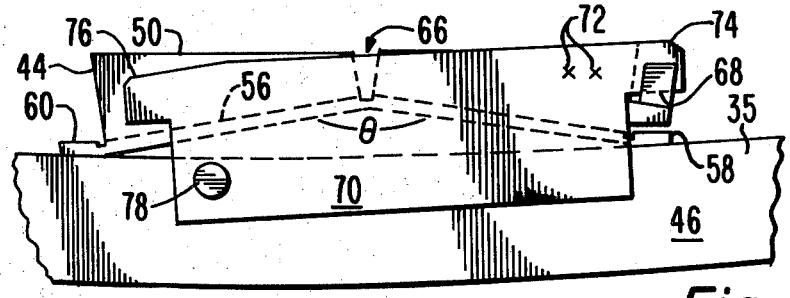
Fig. 5
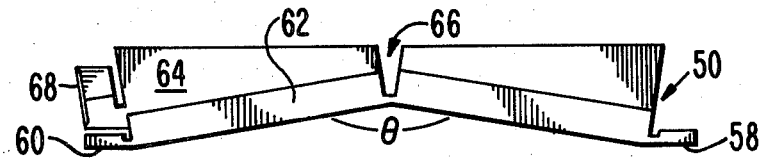
Fig. 6

COLOR PICTURE TUBE HAVING IMPROVED TEMPERATURE COMPENSATING SUPPORT FOR A MASK-FRAME ASSEMBLY

BACKGROUND OF THE INVENTION

This invention relates to color picture tubes of the type having a mask attached to a frame which is suspended in relation to a cathodoluminescent screen, and particularly to a temperature compensating support for suspending the mask-frame assembly within the tube.

In these color picture tubes, the accuracy with which the electron beams strike the individual elemental cathodoluminescent screen areas depends, to a great degree, upon the accuracy with which the mask apertures are aligned with the elemental screen areas during operation of the tube. Thus, should the mask expand by reason of thermal effects occasioned by the impact thereon of the electron beams, the resulting misalignment of the mask apertures and elemental screen areas may cause a portion of the electron beams to impinge upon elemental screen areas other than the ones upon which they were intended to impinge.

Several methods or means have been proposed to compensate for thermal expansion of the mask by causing the mask to move (axially) toward the screen as it expands outwardly, to maintain the desired alignment of the mask apertures and elemental screen areas. One early approach disclosed in U.S. Pat. No. 2,795,719, issued to Morrell on June 11, 1957, proposed movably mounting the mask within the envelope by means of three carriages attached to the periphery of the mask and sliding on inclined tracks mounted on the envelope. Another early approach disclosed in U.S. Pat. No. 2,795,718, issued to van Hekken et al. on June 11, 1957, proposed the use of a multiplicity of flexible hinges connecting the masking member with a supporting frame, or a pivoted bell crank having arms slidably engaging the mask. These compensating means were designed primarily for use with circular masks in round tubes of moderate size and moderate deflection angle.

Most present day color picture tubes utilize a bimetallic mask mounting assembly such as described in U.S. Pat. No. 3,803,436, issued to Morrell on Apr. 9, 1974. In this patent, a bimetallic element is connected between a stud embedded in the faceplate panel and the mask electrode. The bimetallic element may be a spring welded directly to the frame or an intermediate member located between the spring and frame.

Although the bimetallic elements have served well for their intended purpose, their additional cost is relatively high. Therefore, there is a need for further development of thermal compensating mask supports which do not utilize bimetallic elements and which are not mechanically complex.

SUMMARY OF THE INVENTION

An improved color picture tube according to the invention includes an evacuated envelope enclosing a mask attached to a frame which is suspended in relation to a screen by novel support means. The support means includes an elongated metal arch member attached to the frame at two ends, with the central portion of the arch member being spaced from the frame. A spring has one end attached to the arch member between one of the ends and the central portion of the arch member. The other end of the spring engages the tube envelope.

BRIEF DESCRIPTION OF THE DRAWINGS

FIG. 3 is an enlarged plan view of the portion of the tube of FIG. 1 which is circled and labeled 3.

FIG. 4 is an enlarged view of the portion of the faceplate and mask-frame assembly of FIG. 2 which is circled and labeled 4.

FIG. 5 is a view of the mask-frame support taken at line 5—5 of FIG. 4.

FIG. 6 is a view of the mask-frame support arch, without the spring, taken at line 6—6 of FIG. 4.

DETAILED DESCRIPTION

Figure 1:
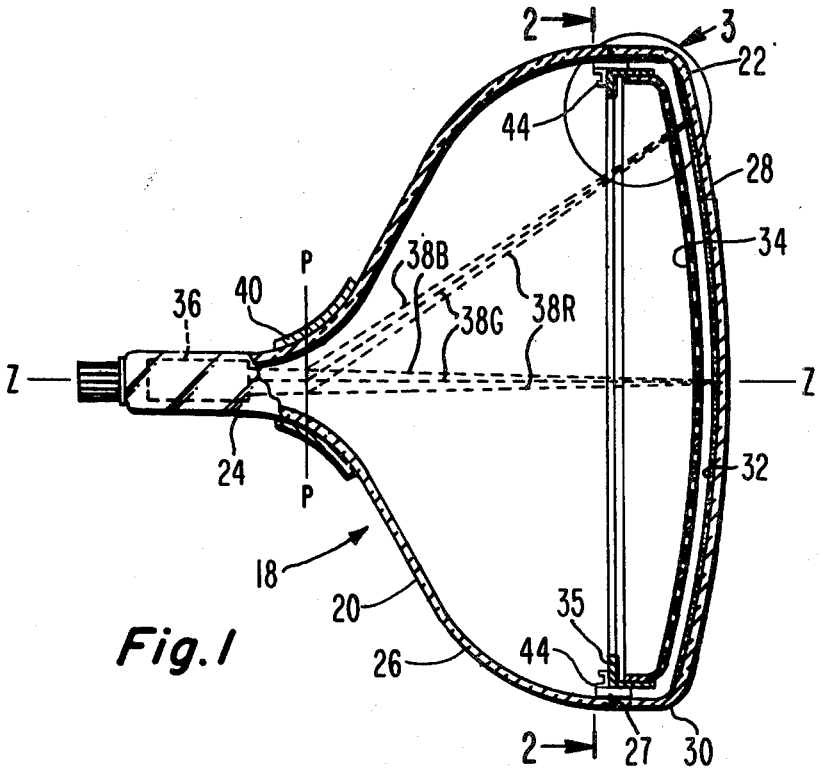
FIG. 1 is a plan view in axial section of an apertured mask cathode-ray tube.

FIG. 1 illustrates a rectangular color picture tube 18 having an evacuated glass envelope 20 comprising a faceplate panel 22 and a tubular neck 24 joined by a funnel 26. The panel 22 comprises a viewing faceplate 28 and a peripheral flange or sidewall 30 which is sealed to the funnel 26 by a frit material 27. A mosaic three-color cathodoluminescent line screen 32 is located on the inner surface of the faceplate 28. The screen 32 comprises an array of phosphor lines extending substantially parallel to the vertical axis of the tube. Portions of the screen 32 may be covered with a light absorbing material in a manner known in the art. A multiapertured color selection electrode or shadow mask 34, attached to an L-shaped frame 35, is removably mounted within the panel 22 in predetermined spaced relationship to the screen 32. A novel support for this mask-frame assembly is described in detail below. The mask 34 includes a multiplicity of slit-shaped apertures which are aligned in substantially parallel vertical columns and web portions separating the slits of each column.

An inline electron gun 36 (illustrated schematically) is mounted within the neck 24 to generate and direct three electron beams 38B, 38R and 38G along coplanar convergent paths through the mask 34 to the screen 32.

The tube 18 is designed to be used with an external magnetic deflection yoke 40 surrounding the neck 24 and funnel 26 in the vicinity of their junction. When appropriate voltages are applied to the yoke 40, the three beams 38B, 38R and 38G are subjected to vertical and horizontal magnetic fields that cause the beams to scan horizontally and vertically in a rectangular raster over the screen 32. For simplicity, the actual curvature of the paths of the deflected beams in the deflection zone is not shown in FIG. 1. Instead, the beams are schematically shown as having an instantaneous bend at the plane of deflection P—P.

Figure 2:
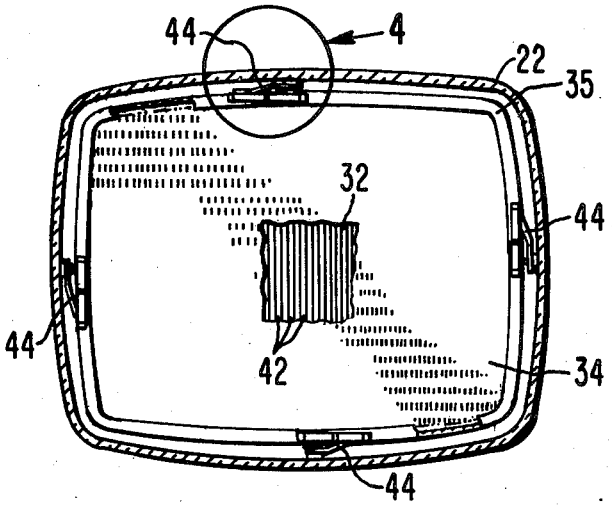
FIG. 2 is a back view of the faceplate and mask-frame assembly to the tube of FIG. 1.

A portion of the screen 32, partially covered by the mask 34, is illustrated in FIG. 2. The screen 32 comprises alternate, preferably abutting, lines 42 of red, green and blue-emitting phosphor elements. Also shown in FIG. 2 are four mask-frame supports 44 (two of which are shown in FIG. 1) that suspend the assembly of the mask 34 and frame 35 within the panel 22. Although four supports 44 are used in this embodiment, other embodiments could use for example two or three. FIGS. 3, 4, 5 and 6 show the mask-frame supports 44 in greater detail.

The frame 35 has an L-shaped cross-section with a first flange 46 extending toward the screen 32, as shown in FIG. 3, and a second flange 48 extending toward the central longitudinal axis Z—Z of the tube 18, as shown in FIG. 1. Each mask-frame support 44 includes an arch member 50 which is welded at points 52 and 54 to the side of the second frame flange 48 opposite the screen 32. The arch member 50 comprises a base portion 56 which is angled $\theta$ approximately 168 degrees in the center, thus keeping the central portion of the arch member spaced from the frame. Two sections 58 and 60 at the ends of the base portion 56 are substantially copolanar, and are welded to the second flange 48 of the frame 35. There are two flanges 62 and 64 extending substantially perpendicularly from the sides of the base portion 56. Both of these flanges 62 and 64 have gaps 66 at their centers to permit flexing of the base portion 56. One of the flanges 64 includes a hook portion 68 that extends out of the plane of the flange 64.

A spring 70 is welded to the flange 64 at a plurality of points 72. The points 72 are located between the end section 58 and the center portion of the arch member 44 as defined by the location of the gaps 66. The spring 70 essentially comprises an elongated flat plate having an offsetting bend near the middle. One end of the spring 70 has a projection 74 extending from it which engages the hook portion 68 of the arch member 50. The purpose of the spring projection 74 and hook portion 68 is hold the spring 70 in place prior to its being welded to the arch member 50. The other end of the spring 70 has another projection 76 extending therefrom. The purpose of this second projection 76 is to permit manual depression of the spring 70 during insertion or removal of the mask-frame assembly. The spring 70 includes an aperture 78 at the end opposite the end which is welded to the arch member 50. This aperture 78 engages a metal stud 80 which is embedded into the sidewall 30 of the faceplate panel 22.

In the preferred embodiment, the frame 35 is of steel and the arch member 50 is of a stainless steel whose thermal coefficient of expansion is not close to that of the frame steel. In the specific example shown where the arch angle $\theta$ is 168 degrees optimum correction is provided for an approximately four-inch long (10.16 cm) arch member 50 made of 304 stainless steel when attached to a frame 35 of 1010 steel. In such embodiment, the arch material has a greater coefficient of thermal expansion than does the frame material and therefore the height of the arch member 50 increases as the frame 35 and arch member 50 are heated. Utilization of different materials, of course, requires appropriate modifications of the angle $\theta$. In yet another embodiment, the arch member 50 may be made of an iron alloy having the composition of 63.8% Fe, 36% Ni and 0.2% C and therefore have a lower coefficient of expansion than the 1010 steel frame. In this case, the height of the arch will decrease as the arch member 50 and the frame 35 are heated. Because of this, the spring in such an embodiment must be attached between the opposite end and the center of the arch member 50 to provide the same correction in mask location.

When the tube 18 is activated, the electron beams 38 strike the mask 34 and frame 35 causing these elements as well as the supports 44 to heat up. Heating the arch member 50 causes it to expand thereby increasing the spacing between the center portion of the arch member 50 and the frame 35. This spacing change, in coordination with the action of the spring aperture 78 on the stud 80, translates into a movement of the shadow mask 34 toward the screen 32.

Although the preferred embodiment is described herein with respect to a line-screen, slit-aperture-mask type color picture tube, the invention is equally applicable to other types of color picture tubes such as dot-screen, circular-aperture type tubes or tubes having other type screens combined with other types mask electrodes.

It should also be understood that the novel mask-frame supports may be used with a tube wherein the frame is an integral portion of the mask, such as may be formed by suitable bending of the mask skirt. Furthermore, although the novel support embodiment described herein will cause the mask to be moved toward the screen when the support is heated, the support can be used to move the mask away from the screen as the support is heated, by attaching the spring to the other arch portion located between the other end section 60 and the central portion of the arch.

What is claimed is:

1. In a color picture tube including an evacuated envelope enclosing an apertured mask attached to a frame which is suspended in relation to a screen by support means, said frame having two flanges formed in an L-shape with a first of the flanges extending toward the screen and a second of the flanges extending inwardly toward the center of the tube, the improvement comprising said support means including an elongated metal arch member attached to the second flange of said frame, said arch member being of a material having a different coefficient of thermal expansion than said frame, said arch member including a base portion which is angled in the center to space the center of said base portion from the second flange of said frame and said arch member including two sections at the ends of said base portion which are substantially copolanar and are welded to the second of the flange of said frame and a spring having one end attached to a side of said base portion between one of the two sections and the angled center of said base portion and the other end engaging said envelope.

2. The tube as defined in claim 1, wherein said arch member has a greater coefficient of thermal expansion than does said frame.

3. The tube as defined in claim 2, wherein said arch member is of a stainless steel and said frame is of a steel.

4. The tube as defined in claim 3, wherein said arch member is of 304 stainless steel and said frame is of 1010 steel.

5. The tube as defined in claim 1, wherein said arch member has a lower coefficient of thermal expansion than does said frame.

6. The tube as defined in claim 5, wherein said arch member is of an iron alloy having the composition of 63.8% Fe, 36% Ni, and 0.2% C and said frame is of a steel.

7. The tube as defined in claim 1, wherein said arch member includes a hook portion for holding said spring.

* * * * *